United States Patent [19]

Morrone

[11] 4,082,385

[45] Apr. 4, 1978

[54] RECORD ALBUM FILING CABINET

[76] Inventor: James V. Morrone, 16 Forrest St., Winthrop, Mass. 02152

[21] Appl. No.: 245,435

[22] Filed: Apr. 19, 1972

[51] Int. Cl.[2] ..... A47B 81/06

[52] U.S. Cl. ..... 312/10; 209/80.5; 211/40; 211/50; 211/55; 312/234.1

[58] Field of Search ..... 312/9, 10, 12, 234.1, 312/234.2; 211/40, 55, 10, 11, 50; 209/80.5

[56] References Cited

U.S. PATENT DOCUMENTS

| | | | |
|---|---|---|---|
| 989,031 | 4/1911 | Oliver | 312/12 |
| 1,250,887 | 12/1917 | Terum | 312/10 |
| 1,437,608 | 12/1922 | Neely | 312/12 |

*Primary Examiner*—James C. Mitchell

*Attorney, Agent, or Firm*—Wolf, Greenfield & Sacks

[57] ABSTRACT

A phonograph record album filing cabinet characterized by a structure wherein a record may be easily selected for use and which may be easily returned to its original place in the cabinet easily after use.

5 Claims, 6 Drawing Figures

RECORD ALBUM FILING CABINET

BACKGROUND OF THE INVENTION

1. Field of the Invention

The invention resides in the field of record album cabinets of the type wherein records are to be easily selected for use and wherein they each are simply and easily returned to their original position within the cabinet.

2. Description of the Prior Art

Prior to the present invention, record album cabinets of which I am aware are characterized by providing complicated mechanical or electrical devices for selecting records for use and for returning them to the cabinet. None that I know of provide a simple, economical structure whereby the records may be returned to the cabinet in their original location manually so that they may be readily found when it is desired to play the record again.

SUMMARY OF THE INVENTION

The present invention contemplates a highly efficient record album filing cabinet wherein selection and return of records from the cabinet is accomplished in a simple, highly efficient manner. The invention relates to a cabinet and to a novel clip attachment for the record album. Provision is made for enabling each record in its album to be returned to its original position on a particular shelf in the cabinet. Provision is also made for enabling a particular record to be quickly selected for use.

Accordingly, the invention has for an object to provide a record album filing cabinet having novel means for making certain each record is returned to its proper position in the cabinet and cooperating means is provided for attachment to the album such that the album is substantially returned to its prior position in the cabinet.

The invention has for another object to provide novel means whereby a particular record album may be selected in a rapid and efficient manner.

Another object of the invention lies in the fact that any number of albums can be removed from the cabinet mixed up and still very readily be returned to their former predetermined positions in the cabinet.

A still further object of the invention is to provide an economical cabinet free of moving mechanical or electrical parts in which the records are loaded into the cabinet from one side and selected and removed from the opposite side thereof.

With these general objects in view and such others as may hereinafter appear, the invention consists in the filing cabinet, cooperating clips and in the various structures and arrangements of the parts hereinafter described and particularly defined in the claims at the end of this specification.

BRIEF DESCRIPTION OF THE DRAWINGS

In the drawings illustrating the preferred embodiment of the invention.

DESCRIPTION OF THE PREFERRED EMBODIMENT

Figure 2:
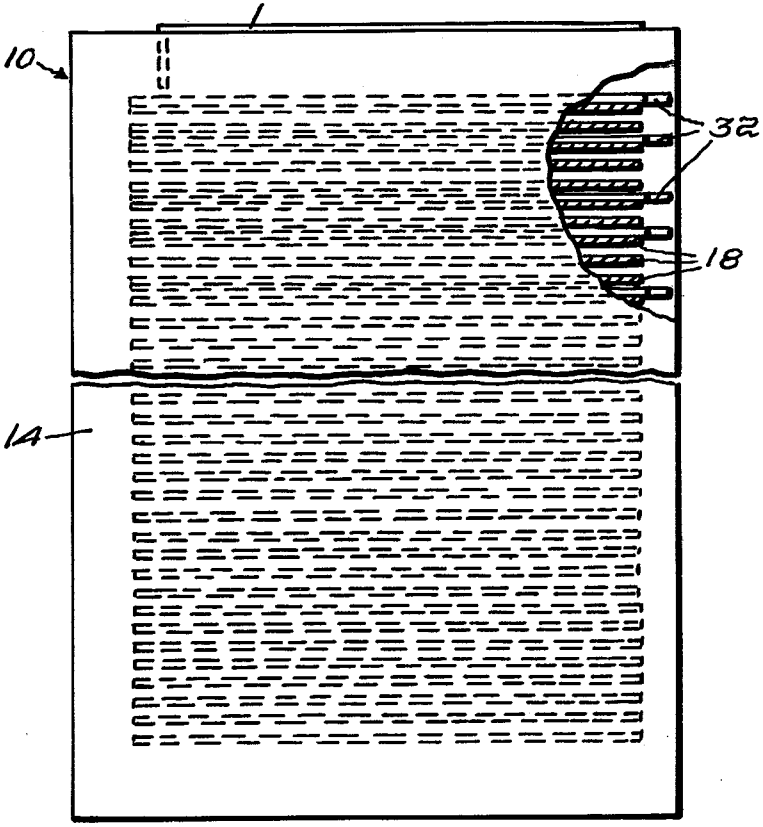
FIG. 2 is a side elevation partially broken away of the cabinet.
Figure 1:
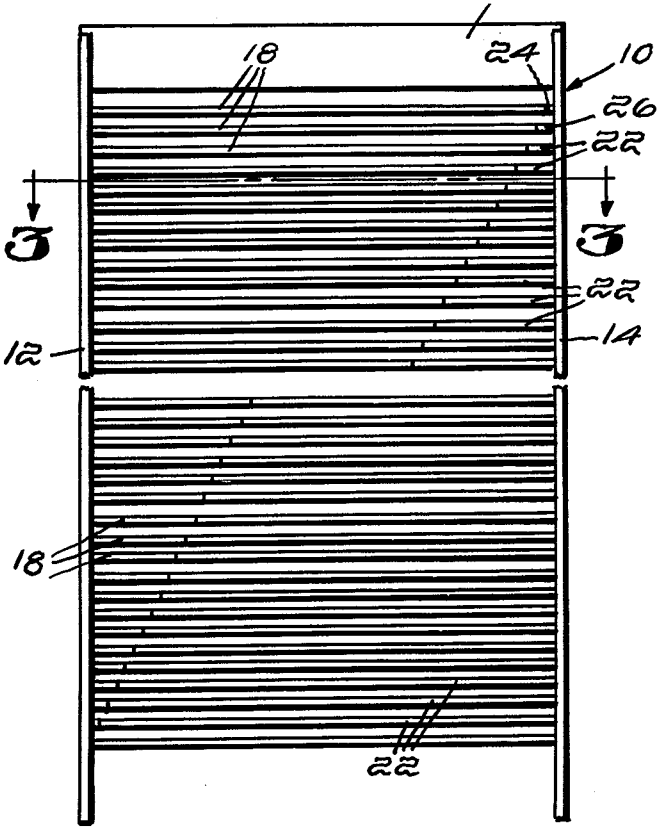
FIG. 1 is a front elevation of the present cabinet.
Figure 3:
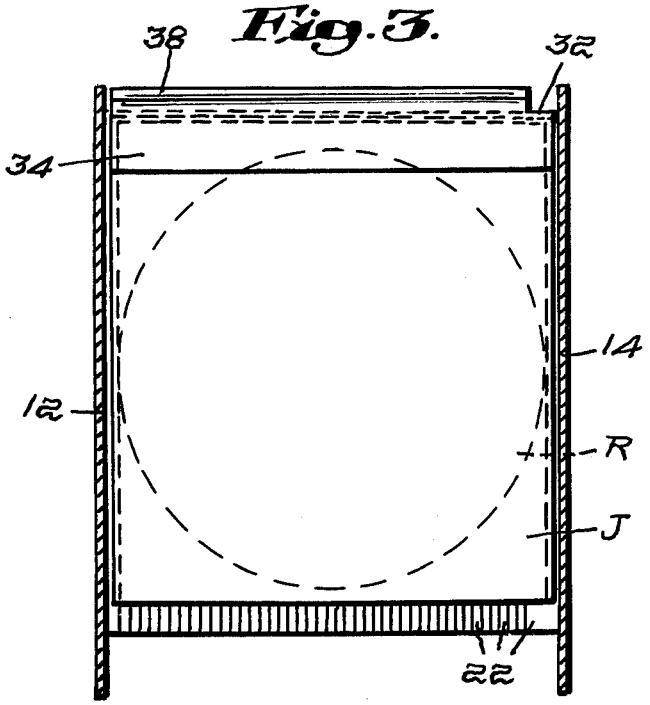
FIG. 3 is a top view of the cabinet.
Figure 4:
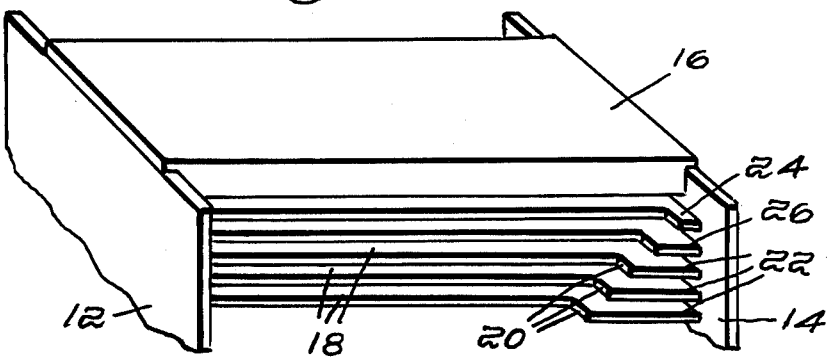
FIG. 4 is a perspective view of the upper portion of the cabinet illustrating the shelves and tabs.

The invention as illustrated in the drawings and in FIGS. 1 and 4 in particular comprises a standing cabinet 10 which consists of vertical side walls 12, 14 and a top member 16 which is secured by any suitable means to the top portions of the side walls 12, 14 to assist in maintaining the side walls in a vertical and parallel position. A plurality of shelves indicated in general at 18 are also provided and are disposed in vertically spaced relation with each other and connected between the side walls 12, 14 as shown in the drawings. It will be understood that the cabinet may be made of wood or plastic. The particular material from which it is made is not part of the invention as such.

Referring to FIG. 4 in particular, each shelf is provided in its front edge with a cutout portion 20 and the remainder of the shelf an extended, substantially rectangular tab 22. As will be apparent from the drawing, FIG. 4, the cutout portions in each shelf from the top shelf to the bottom shelf become progressively shorter in their lateral dimension. For example, the cutout defined by tab 24 in the top shelf is greater in length than the cutout defined by tab 26 in next lower shelf, and so on for each succeeding shelf. In addition, each tab from the top shelf to the bottom is greater in width than the preceding shelf. For example, tab 24 is narrower than tab 26, and so on down each succeeding shelf so that each tab is wider than the tab above it in the cabinet 10.

The cabinet 10, as illustrated in the drawings, is constructed particularly for the purpose of storing or filing phonograph record albums and, consequently, the width is slightly greater than the width of the conventional standard record album jacket J and of a depth slightly greater than the length of the jacket. The cabinet is arranged to hold as many as 99 albums and may hold less if desired. The number of shelves will, of course, determine how many albums may be filed in the cabinet. In practice, the shelves are spaced vertically from one another a distance slightly greater than the thickness of the album R so that the albums may slip into position one on each shelf easily.

Figure 5:
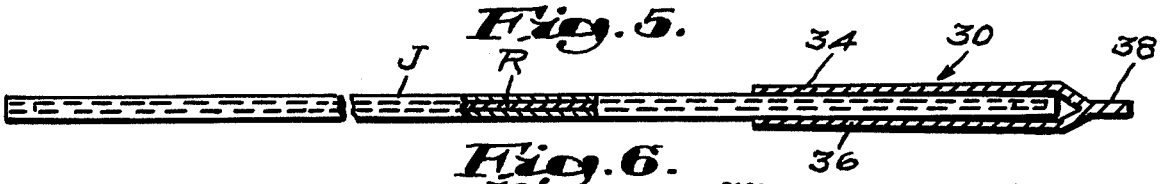
FIG. 5 is an edge view partially in cross section showing the album jacket with the clip attached.
Figure 6:
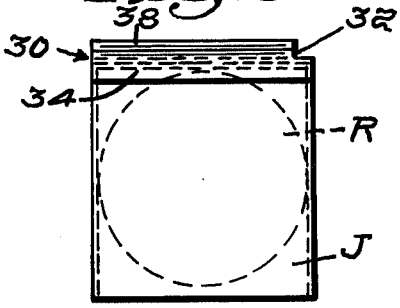
FIG. 6 is a plan view of the album and attached clip.

As illustrated in FIGS. 5 and 6, a clip 30 arranged to be snugly slipped onto the album jacket is provided. In accordance with the invention, a clip is provided for each album jacket. Each clip 30 comprises a flat extension having a cutout 32 in one corner and an integral pair of spring legs 34, 36 arranged to engage opposite sides of the album jacket when the clip is in position on the jacket.

Each clip of a series of clips for each album to be filed in the cabinet 10 has a cutout portion 32, and each cutout is slightly greater in width than the preceding one so that the clip used on the record jacket for the shelf next below the top shelf has a cutout slightly greater in width than the width of tab 24 and less than the width of tab 26 and so on. There is a clip for each jacket for each shelf.

Each of the clips are numbered in any manner desired. The numbers are imposed on the upper surface of the clip extension as at 38 in any suitable manner.

In utilizing the present invention, a series of clips, each having a cutout portion of a dimension slightly greater than the width of a tab in the series of shelves, are provided. A clip is slipped into a single jacket. The jacket with the clip attached is directed toward the front of the cabinet inserted partially and permitted to drop into place on the shelf until the extended portion of the clip rests on a particular tab. In this manner, a single particular shelf is selected and the jacket slipped onto the shelf. When the jacket is fully inserted into the cabinet, the clip will extend into view at the back of the cabinet such that the numbers on the surface of the clip may be easily read; thereby, a particular record can be readily selected for use. Since the tabs and cutouts correspond, when it is desired to return the record to the cabinet after use, it may be done easily with the record being returned to exactly the same shelf in the cabinet. After using this invention just a few times, the number will automatically come to the user's mind that corresponds with the record he wants to hear. In other wordds, it is filed simply in the same place after each use whereby the user saves times in locating a particular record when he wants to hear it played.

It will be understood that the clip will remain on the jacket when the record itself is removed and the record filed merely by placing it in its jacket and directing the clip edge toward the shelves and letting it fall into place on the shelf to which it belongs.

While the invention has been described as embodying a phonograph record cabinet, it will be understood that it may be used to file any number of other records using the same structure, each record being readily returned to its proper place after use.

Having thus described the invention, what is claimed is:

1. A cabinet for filing folders containing phonograph records which comprises a body having side walls and a top wall, and a plurality of shelves secured between the side walls in spaced relation to each other a distance apart slightly greater than the record folder to be filed, each of said shelves having an extended tab portion along the front edge, each tab from top to bottom being of slightly greater width than the preceding tab; a plurality of folders, each of said folders having a cutout portion along one edge slightly greater in length than the width of a tab on a particular shelf whereby a folder presented to the cabinet for filing will fall onto an adjacent shelf wherein the length of the cutout portion is less than the width of the tab on that shelf, thus each folder may be returned to its proper shelf after use.

2. A cabinet as defined in claim 1 wherein a clip is provided and detachably secured to each folder, and each clip has a cutout portion of a length slightly greater than the width of the tab of the particular shelf.

3. A cabinet as defined in claim 2 wherein each clip is provided with a different marking on its surface for assisting the user in selecting a particular folder.

4. A cabinet as defined in claim 1 wherein the folders are selected from the back thereof and the folders are filed therein from the front.

5. A filing cabinet for the storage of records which comprises a cabinet having a top wall and parallel vertical side walls and a plurality of spaced shelves upon which record albums may be filed and stored, said shelves being secured between the side walls, each of the shelves having a cutout portion in the front edge and an extended tab portion, said cutouts each being of progressively less length relative to the preceding shelf, a plurality of clips, each having a cutout portion in one edge, and a pair of legs engaging the record album along one edge thereof, each clip having its cutout portion of a size corresponding substantially to but less than the width of a particular tab on a particular shelf so that the record may be only returned to a single shelf by matching the cutout in the clip attached to the album with a particular tab on the shelf.

* * * * *